United States Patent [19]

Nicholson

[11] 4,183,403

[45] Jan. 15, 1980

[54] PLATE TYPE HEAT EXCHANGERS

[76] Inventor: Terence P. Nicholson, Calf Hall, Muggleswick, Derwentisde, Co. Durham, England

[21] Appl. No.: 614,251

[22] Filed: Sep. 17, 1975

[30] Foreign Application Priority Data

Feb. 7, 1973 [GB] United Kingdom ..... 5359/73

[51] Int. Cl.[2] ..... F28F 3/02

[52] U.S. Cl. ..... 165/166

[58] Field of Search ..... 165/166, 157, 170

[56] References Cited

U.S. PATENT DOCUMENTS

| | | | |
|---|---|---|---|
| 1,805,652 | 5/1931 | Caracristi | 165/166 |
| 2,858,112 | 10/1958 | Gersturg | 165/166 |
| 3,255,816 | 6/1966 | Rosenblad | 165/166 |
| 3,280,906 | 10/1966 | Rosenblad | 165/166 |

FOREIGN PATENT DOCUMENTS

| | | | |
|---|---|---|---|
| 270600 | 5/1927 | United Kingdom | 165/166 |
| 1136297 | 12/1968 | United Kingdom | 165/166 |

*Primary Examiner*—Samuel Scott
*Assistant Examiner*—Theophil W. Streule, Jr.

[57] ABSTRACT

A heat exchanger has a number of corrugated plates arranged one above the other with spaces between them. The two fluids between which heat is to be exchanged flow in counter-flow relationship in alternate spaces between the plates. The plates are arranged so that the flow passages between them are of constant width across the whole flow-section of the heat exchanger, and spacers are mounted on some of the corrugations to maintain the plates the correct distance apart.

4 Claims, 8 Drawing Figures

PLATE TYPE HEAT EXCHANGERS

The invention relates to heat exchangers of the kind in which fluid flow passages are formed between interleaved parallel opposed plates and the fluids between which heat is to be exchanged are caused to flow in opposite directions to one another in alternate flow passages between the plates.

In accordance with the present invention, and with the general object of promoting highly efficient heat exchange between fluids, a heat exchanger of the kind referred to is characterised in that the plates are corrugated in planes transverse to the directions of fluid flow with the corrugations aligned so that flow passages defined between them are of constant width measured between straight sections of adjoining plates. Preferably the corrugations are of multiple substantially V-shaped configuration.

Since in heat exchangers of the kind referred to there is invariably a pressure differential between the two fluids it is necessary to provide between the plates some form of reinforcement or spacing device to prevent collapse or partial closure of the passages which contain the lower pressure fluid. One mode of reinforcement which has been tried is a corrugated spacer bar contained in the passage between adjacent plates and having its corrugations in contact with the inside facing surfaces of the plates.

Another mode of reinforcement involves the use of plain slightly cranked strips of metal fitted within the flow passage so as to contact and bridge inward corrugations along the flow path of the fluid between the plates.

The disadvantage of only using ordinary transverse spacing bars between straight end sections of adjoining plates is the difference in the width of the formed passage at the straights and the bends thereof, whilst the disadvantage of using a corrugated bar structure is the non-uniform character of the triangular ducts which it necessarily forms and which result in an extremely low nusselt number. However, the use of plain slightly cranked strips creates sinusoidal ducts which result in an even less satisfactory nusselt number.

Instead therefore of these expedients it is further proposed in accordance with the present invention to provide a heat exchanger of the kind referred to and as defined in paragraph 2 of this specification with internal spacing members extending transversely across the passages between the plates at some at least of the corrugation bends thereof, the depth and side edge dimensions and configuration of the spacing members being such as to render constant the width of the passage between adjoining plates at such bends whilst also maintaining the width of the remainder of the passages constant despite differences of pressure of fluids flowing in adjacent passages.

Preferably the intermediate spacing members are situated at alternate corrugation bends along any particular passage and the arrangement of such spacing members in one passage alternates with the arrangement of like parts in adjacent passages, since this configuration is the most favourable from a heat exchanger aspect. However, in practice it may, because of high pressure differential, be necessary to have the spacing members directly opposite each other but it is best to avoid this practice if possible.

To obtain the best flow characteristics (high nusselt number) it is best to obtain the greatest ratio possible between the depth and length of each passage.

A particular and at present preferred form of heat exchanger in accordance with the present invention is suitable for transferring heat from a high temperature fluid such as exhaust gas to air. One such heat exchanger will now be described by reference to the accompanying drawings, in which.

Figure 1:
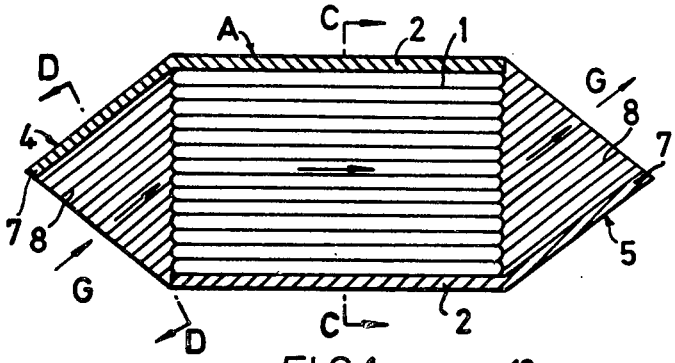
FIG. 1 is a plan view, partly in section, of a first form of plate used in the heat exchanger.
Figure 2:
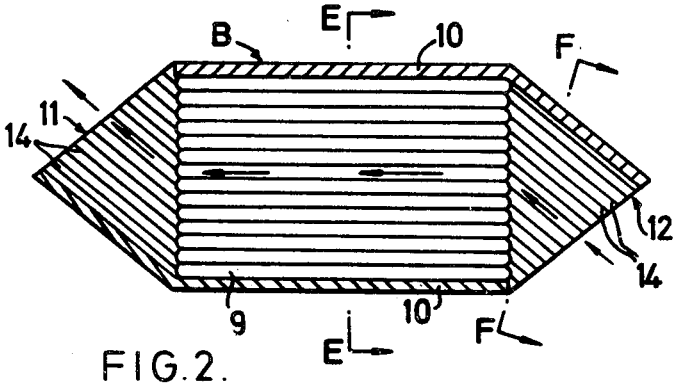
FIG. 2 is a plan view, partly in section, of a second form of plate used in conjunction with the form of plate shown in FIG. 1.

Referring now to the drawings, the heat exchanger—otherwise known as a "prime surface recuperator" is mainly comprised of a plurality of specially formed plates "A" as shown in FIG. 1 and plates "B" as shown in FIG. 2 which are alternately interleaved to form a stack and permanently welded together. When the plates are thus assembled there is formed a plurality of flow channels of corrugated shape and uniform depth. In operation a fluid such as air is passed through alternate flow channels in a direction perpendicular to the plane of corrugation whilst another fluid, such as a gas at a different temperature, is passed through the other alternate flow channels in a direction perpendicular to the plane of corrugation. Preferably the respective fluids flow counter to one another from end-to-end of the plate assembly.

Figure 3:
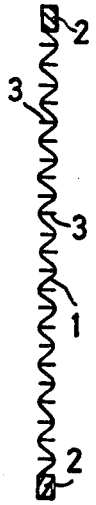
FIG. 3 is an enlarged section on line C—C of FIG. 1.
Figure 4:
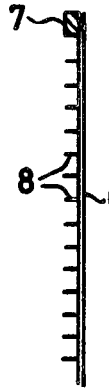
FIG. 4 is an enlarged section on line D—D of FIG. 1.
Figure 8:
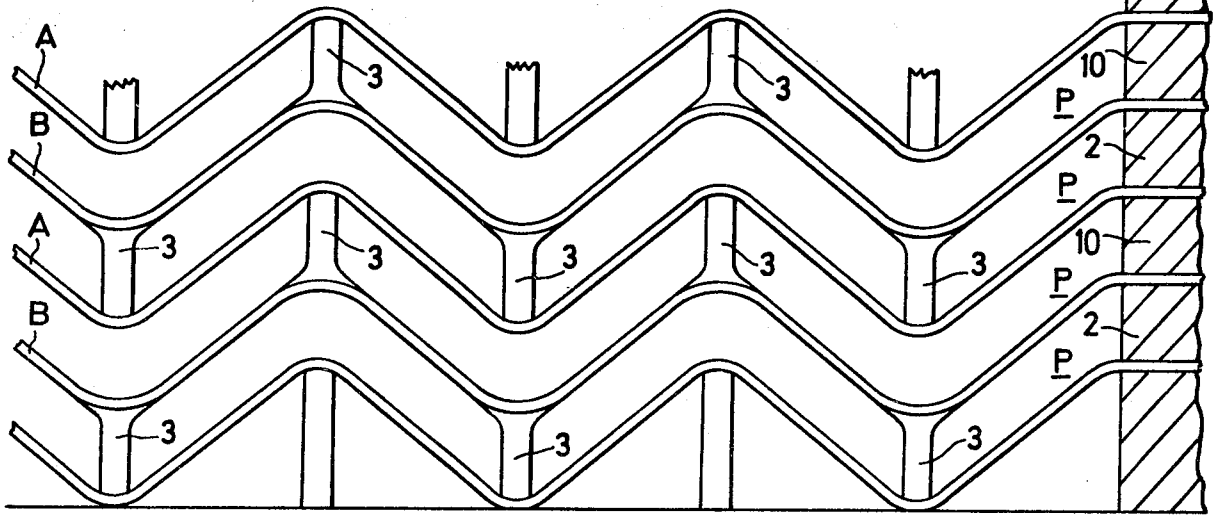
FIG. 8 is an enlarged sectional view showing the mode of stacking of the first and second forms of plate to form a heat exchanger.

Referring now to FIGS. 1, 3 and 4, each plate A comprises a main rectangular section comprising a thin uniformly corrugated base sheet 1 of metal having a high thermal conductivity and to the side edges of which rectangular section spacer bars 2 are welded. Also secured by welding to the centres of the concave parts of the base plate is a multiplicity of intermediate spacer bars 3, which as hereinafter explained in more detail by reference to FIG. 8 are for the purpose of preventing collapsing of the plates and maintaining the depth of the flow passages uniform when there is a pressure difference between the counterflowing fluids in adjacent passages.

The plate A has a pair of oppositely directed end sections 4, 5 of triangular shape at its respective ends, each such section comprising a flat base sheet 6 having a spacer bar 7 secured by welding along one side edge. Each base sheet 6 also has welded to it a series of parallel guide and spacer vanes 8. The arrows G indicate the directions of flow of gas past the top face of the plate A.

Figure 6:
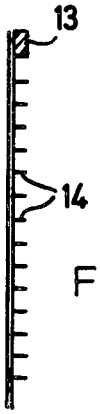
FIG. 6 is an enlarged section on line F—F of FIG. 2.
Figure 5:
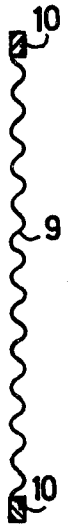
FIG. 5 is an enlarged section on line E—E of FIG. 2.

Referring now to FIGS. 2, 5 and 6, each plate B comprises a main rectangular section comprising a thin uniformly corrugated base sheet 9 which resembles the base sheet 1 of a plate A except that it is not provided with spacer bars 3. It is however provided with spacer bars 10 welded to opposite side edges in the same manner as the bars 2 are welded to the base sheet of the plate A.

Figure 7:
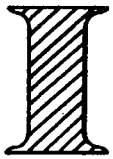
FIG. 7 is an enlarged cross-section of a preferred form of guide vane.

The plate B also has a pair of oppositely directed end sections 11, 12 of triangular shape with spacer bar 13 and guide and spacer vanes 14 all of which are similar to the end sections 4, 5 respectively of plate A but in reversed orientation compared therewith. The arrows 4 in FIG. 2 indicate the direction of flow of air past the top side of the plate such directions being counter to the directions of glad flow G past an adjacent plate A after assembly of the heat exchanger. The guide and spacer vanes 8, 14 preferably have the cross-section indicated to a larger scale in FIG. 7.

To form a complete heat exchanger unit a plurality of the plates A and B are stacked alternately upon one another and sandwiched between top and bottom plates which may have the same configuration as the plates A and B but which are of greater thickness.

The heat exchanger elements mentioned above are stacked for assembly in a special jig. This jig comprises a base member having eight vertical dowels for the purpose of locating the bottom plate, the main heat exchanger plates and the top plate in their aligned positions, with the peripheral angled and transverse spacer bars and triangular support plates located therebetween. It is to be understood that the dowels are located outside the periphery of the heat exchanger components and the assembly is completed by clamping the top and bottom plates towards one another whereafter the heat exchanger matrix is argon arc welded down the full height of the matrix at suitable points around its periphery whereafter it is removed from the jig.

The whole assembly is now coated with a brazing compound and passed through a brazing cycle in a furnace so as to become a single integral unit.

Finally, components such as a suitable ducting or flanges are welded onto the assembly to suit the installation with which it is intended to be used.

Referring now to FIG. 8 which is a cross-section on a greatly enlarged scale through four plates alternately of type A and type B and an end plate welded together, it is to be noted that the intermediate spacer bars 3 are situated at alternate bends in the flow passages P and that the spacer bars 3 of adjacent flow passages are staggered relative to one another.

Not only do the spacer bars 3 serve to maintain constant the gaps between the straight parallel parts of adjacent plates A and B but they also serve, by reason of their splayed side edge configuration to strengthen the bends and maintain constant the width of the flow passages at the bends where the spacer bars are located.

Typically in the example shown the spacer bars 2 or 10 have a thickness of 0.040 inches, the distance between corrugations is 0.200 inches, the sheet thickness is 0.004 inches and the constant flow passage width (gap) between straight parts of adjacent plates is 0.035 inches. The width of the intermediate spacer bars 3 is 0.015 inches.

Obviously these dimensions would be varied to suit different operational requirements.

Obviously also, intermediate spacer bars could be placed at all the bends of the flow passages if desired but this is not found in practice to be necessary, since any advantage derived from doing so could be nullified by the extra resistance to fluid flow which would be offered.

I claim:

1. A heat exchanger comprising spacer bars carrying corrugated sheets and assembled with the sheets in parallel closely conforming superimposed spaced-apart relationship and with the peaks and troughs of the corrugations in adjacent sheets being in alignment and extending in the same direction, said adjacent sheets forming flow passages running along the corrugations thereof, means for supporting the sheets in said spaced-apart relationship, said means extending in engaging relation between the corrugation peaks of alternate pairs of adjacent sheets and between corrugation troughs of intervening pairs of adjacent sheets, and inlet and outlet means for passing a first heat-exchange fluid through said alternate pair of adjacent sheets in a first direction, and for passing a second heat-exchange fluid through the intervening pairs of adjacent sheets in a second direction opposite to said first direction.

2. The heat exchanger of claim 1, wherein the means for supporting the sheets comprises spacing members extending longitudinally along the flow passages between said adjacent sheets, the distance between the adjacent peaks or troughs of adjacent sheets being adjusted by the dimensions of the spacing members to be equal to the distance between the parts of the adjacent sheets, joining the peaks and the troughs, when measured perpendicular to said parts.

3. The heat exchanger of claim 2, wherein each said spacing member is splayed at one end where it is attached to the outside surface of a plate corrugation.

4. A heat exchanger comprising a plurality of corrugated sheets arranged in parallel closely conforming superimposed spaced-apart relationship with the peaks of the corrugations in adjacent sheets being in alignment and extending in the same direction and with the troughs of the corrugations in said adjacent sheets also being in alignment and extending in the same direction, said adjacent sheets forming flow passages running along the corrugations thereof, means for supporting the sheets in said spaced-apart relationship with said corrugation peaks and troughs in each sheet lying in common parallel spaced-apart planes and with the troughs and peaks of adjacent sheets lying in common parallel spaced-apart planes perpendicular to the first-named planes, said means extending in engaging relation between the corrugation peaks of alternate pairs of adjacent sheets and between corrugation troughs of pairs of adjacent sheets intervening said alternate pairs of sheets, and inlet and outlet means for passing a first heat-exchange fluid through said alternate pair of adjacent sheets in a first direction and for passing a second heat-exchange fluid through the intervening pairs of adjacent sheets in a second direction opposite to said first direction.

* * * * *